US012369676B2

(12) United States Patent
Rautiainen

(10) Patent No.: US 12,369,676 B2
(45) Date of Patent: Jul. 29, 2025

(54) SUPPORT FOR A GOALKEEPER SKATE AND A GOALKEEPER SKATE

(71) Applicant: BETTERFLY OY, Savonlinna (FI)

(72) Inventor: Kimmo Rautiainen, Savonlinna (FI)

(73) Assignee: BETTERFLY OY, Savonlinna (FI)

( * ) Notice: Subject to any disclaimer, the term of this patent is extended or adjusted under 35 U.S.C. 154(b) by 0 days.

(21) Appl. No.: 18/277,039

(22) PCT Filed: Jan. 21, 2022

(86) PCT No.: PCT/FI2022/050038
§ 371 (c)(1),
(2) Date: Aug. 11, 2023

(87) PCT Pub. No.: WO2022/171929
PCT Pub. Date: Aug. 18, 2022

(65) Prior Publication Data

US 2024/0122290 A1 Apr. 18, 2024

(30) Foreign Application Priority Data

Feb. 12, 2021 (FI) ..... 20215142

(51) Int. Cl.
*A43B 5/18* (2006.01)
*A43B 5/16* (2006.01)
*A63C 3/02* (2006.01)

(52) U.S. Cl.
CPC ..... *A43B 5/18* (2013.01); *A43B 5/16* (2013.01); *A63C 3/02* (2013.01)

(58) Field of Classification Search
CPC ..... A43B 5/1683; A43B 5/1691; A43B 7/20; A43B 5/18; A43B 5/16
USPC ..... 280/811
See application file for complete search history.

(56) References Cited

U.S. PATENT DOCUMENTS 2,211,822 A 8/1940 Jennings
2,617,207 A 11/1952 Jennett
2,789,374 A 4/1957 Planert
5,234,230 A 8/1993 Crane et al.
5,373,584 A * 12/1994 Parcells, III ..... A41D 13/0153 2/24
5,829,170 A * 11/1998 Lutz, Jr. ..... A43B 5/18 36/7.1 R (Continued)

FOREIGN PATENT DOCUMENTS

WO 2020206548 A1 10/2020

OTHER PUBLICATIONS

International Search Report and Written Opinion in Application No. PCT/FI2022/050038, mailed Apr. 12, 2022, 10 pages.

(Continued)

*Primary Examiner* — James A Shriver, II
*Assistant Examiner* — Hilary L Johns
(74) *Attorney, Agent, or Firm* — Meunier Carlin & Curfman LLC

(57) ABSTRACT

The invention discloses a support for a goalkeeper skate and a goalkeeper skate. A support for a goalkeeper skate comprises a protrusion arrangeable on a medial (M) side of the goalkeeper skate. A goalkeeper skate comprising said support is also disclosed. The support and the goalkeeper skate disclosed herein may be used for aligning joints in lower extremities including hip, knee, and ankle joints of an ice hockey or roller hockey goalkeeper.

12 Claims, 3 Drawing Sheets

(56) References Cited

U.S. PATENT DOCUMENTS

| | | | | |
|---|---|---|---|---|
| 7,793,947 | B2 * | 9/2010 | Labonte | B29D 35/0054 280/841 |
| 8,109,536 | B2 * | 2/2012 | Labonte | B29D 35/126 280/841 |
| 8,959,801 | B1 | 2/2015 | Siragusa, Jr. | |
| 11,234,481 | B2 * | 2/2022 | Seguin | A43B 5/1641 |
| 11,510,455 | B2 * | 11/2022 | Alexander | A63C 1/22 |
| 11,825,908 | B2 * | 11/2023 | Seguin | A43B 5/1641 |
| 2001/0025439 | A1 * | 10/2001 | Graf | A63C 3/00 36/131 |
| 2003/0151213 | A1 * | 8/2003 | Balconi | A43B 5/1691 280/11.19 |
| 2008/0307674 | A1 | 12/2008 | Dean | |
| 2019/0191816 | A1 * | 6/2019 | Seguin | A43B 5/1666 |
| 2022/0071340 | A1 * | 3/2022 | Alexander | A43B 5/1658 |
| 2022/0312887 | A1 * | 10/2022 | Seguin | A43B 5/1666 |

OTHER PUBLICATIONS

Extended European Search Report issued for Application No. 22752391.7, dated Dec. 6, 2024. 7 pages.

* cited by examiner

SUPPORT FOR A GOALKEEPER SKATE AND A GOALKEEPER SKATE

CROSS REFERENCES

This is a U.S. national stage application of the international patent application number PCT/FI2022/050038 filed on Jan. 21, 2022 and claiming priority to Finnish national application number 20215142 filed on Feb. 12, 2021.

TECHNICAL FIELD

The present disclosure relates to a support for an athletic footwear, specifically to a support for a goalkeeper skate, more specifically to a support for an ice hockey or a roller hockey goalkeeper skate. The disclosure also relates to a goalkeeper skate.

BACKGROUND

In ice hockey, the goalkeeper has a specific and unique role to prevent opponent from scoring goals. This role is further emphasized with specific equipment. In order to block and catch the puck the goalkeeper often has to not only stand but try to cover or block as much as possible of the area of the goal. The goalkeeper often assumes an angled position where the blades of the skates are angled away from the goalkeeper and legs extend to the sides to cover the goal area. The goalkeeper may even drop down to a "butterfly position" where the knees stay together while they touch the ice. At the same time, the goalkeeper's lower legs (tibiae) flex and spread apart to cover the lower corners of the goal to complete the butterfly position.

Modern, existing goalkeeper skates do not support the ankles when the goalkeeper drops on to her/his knees on the ice, for example into the "butterfly position". The ankles and heels hit the ice, ankle bends, and in the worst case, the balls of the feet and the feet may be pointing upwards. Even toes may point upwards. This may also force the knees and hips to extend the bend and to expose the joints to stress injuries. Strain and injuries may also be caused to tendons and supporting muscles. In essence, this is not a mere short-term discomfort but increases the long-term injury risk and may shorten the career expectancy of goalkeepers who repeatedly block in the "butterfly position".

US20010025439A1 discloses a domed protrusion foreseen at the inner instep side of a skate boot facilitating the getting up of the skater.

WO2020206548A1 discloses a grip positioned to form an outer surface of a boot of a goalie skate.

U.S. Pat. No. 5,234,230A discloses an ankle and foot protective device for attachment to a skate.

US2008307674A1 discloses a support, comprising a protrusion arrangeable on a side of the shoe.

SUMMARY

The solution presented in this specification solves or at least alleviates the problem of bending of the goalkeeper's ankle in the modern goalkeeper skate and the subsequent injuries in lower extremities, such as ankle, knee, and hip joint injuries. The support disclosed herein is arranged to reduce stress in lower extremities including hip, knee and ankle joints with attached nerves, tendons, muscles, and muscle membranes.

According to an embodiment a support for a goalkeeper skate is provided. The support comprises a protrusion arrangeable on a medial side of the goalkeeper skate. The protrusion is arranged to align a heel-to-toes axis of the goalkeeper skate to be at an angle of from 0 to −30 degrees with respect to a horizontal plane when placing the goalkeeper skate onto a horizontal surface such that the medial side of the goalkeeper skate faces the horizontal surface. The protrusion of the support is arrangeable on the goalkeeper skate on heel side on the heel-to-toes axis. Outer surface of the protrusion is arranged to facilitate gliding of the skate when the protrusion is touching the horizontal surface.

According to an embodiment a goalkeeper skate comprising the above-described support is provided.

According to an embodiment the support is used in ice hockey or roller hockey.

According to an embodiment the goalkeeper skate with the support is used in ice hockey or roller hockey.

According to an embodiment a method for aligning joints in lower extremities including hip, knee, and ankle joints of a goalkeeper is disclosed, comprising manufacturing the support described above, or a goalkeeper skate described above.

Further embodiments are presented in the dependent claims.

Although the support is mainly intended for ice hockey or roller hockey goalkeeper skates, the support may be used also in other related sports with possible stress in lower extremities, including hip, knee and ankle joints with attached tendons, muscles, and muscle membranes. The support may be attached to or integrated as part of figure skates, speed skates, ski boots, floorball shoes, or other footwear related to activities where ankle support may be beneficial.

Figure 1:
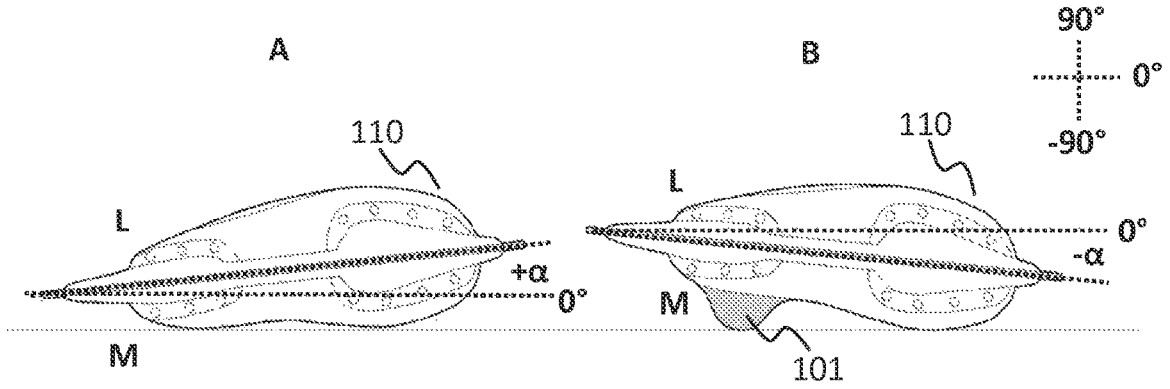
FIG. 1A, B demonstrates, by way of an example, the alignment of the goalkeeper skate in respect to the horizontal surface using a goalkeeper skate without the support (1A) and with the support (1B).

The figures are schematic. The figures are not in any particular scale.

DETAILED DESCRIPTION

The solution is described in the following in more detail with reference to some embodiments, which shall not be regarded as limiting.

In this description and claims, term "comprising" may be used as an open term, but it also comprises the closed term "consisting of". The following reference numbers and denotations are used in this application:

| | |
|---|---|
| 101, 201, 301, 401, 501 | protrusion |
| 300, 400 | support |
| 302, 402 | connection arrangement |
| 303, 304, 305, 403, 404, 405 | strap |

-continued

| | |
|---|---|
| 110, 210, 410 | goalkeeper skate |
| 506 | ankle |
| 507 | knee |
| 508 | hip |
| L | lateral |
| M | medial |
| α | angle |

Within context of this disclosure, the side of an ankle, a knee or a hip that is the facing the corresponding other ankle, other knee, or other hip of the goalkeeper may be referred to as being medial. Inner side of any of the lower extremities may be referred to as the medial side. For example, in a normal standing position the medial side of the left ankle faces essentially to the right, towards the body centre line.

Within context of this disclosure, the side of an ankle, a knee or a hip that is facing away from the corresponding other ankle, other knee, or other hip of the goalkeeper may be referred to as being lateral. Outer side of any of the lower extremities may be referred to as the lateral side. For example, in a normal standing position the lateral side of left ankle faces essentially to the left, away from the body centre line.

Within context of this disclosure, heel-to-toes axis may be referred to as the anterior-posterior axis, where the heel is posterior to the toes and the toes are anterior to the heel. Footplate may be ventral to the foot. Stress may refer to angular stress, excess bending, overstretching, ripping, gradual wear, and/or any other functionality limiting injury to the musculoskeletal system.

Aim of this specification is to provide a support that prevents or hinders the goalkeeper's ankle and heel to drop down onto a surface, such as ice, when dropping down to a "butterfly position" where the goalkeeper's knees stay together while they touch the surface and the lower legs (tibiae) flex and spread apart. The support disclosed herein allows the goalkeeper's lower extremities to maintain more physiological angles thus providing less angular stress, for example, to the ankle, knee, and hip joints. The support may also enable reducing the stress to supporting musculature and tendons.

A support for a goalkeeper skate is provided. The support comprises a protrusion arrangeable on a medial side of the goalkeeper skate. The protrusion may be arranged to align a heel-to-toes axis of the goalkeeper skate to be horizontal when placing the goalkeeper skate onto a horizontal surface such that the medial side of the goalkeeper skate faces the horizontal surface. The horizontal surface may also be referred to as a planar surface. The horizontal surface may be for example a surface of ice. Said placement or position of the goalkeeper skate corresponds to the position of the goalkeeper skate when the goalkeeper assumes the so-called butterfly position.

The protrusion may be arranged to align a heel-to-toes axis of the goalkeeper skate to be at an angle of from 0 to −30 degrees with respect to horizontal plane when placing the goalkeeper skate onto a horizontal surface such that the medial side of the goalkeeper skate faces the horizontal surface. For determining the angle, the heel-to-toes axis is considered to be viewed from the heel to the toes. For the intended purpose and effect of the support, the protrusion is arranged to align the heel-to-toes axis of the goalkeeper skate in such a way that heel part of skate is arranged to be on the same or on a higher level compared to the toe part of the skate with respect to the height from the horizontal surface, when placing the goalkeeper skate onto a horizontal surface such that the medial side of the goalkeeper skate faces the horizontal surface.

FIG. 1A demonstrates the alignment of the conventional goalkeeper skate 110, and thus the alignment of the goalkeeper's foot in respect to a horizontal surface. FIG. 1A illustrates the undesired situation, wherein the heel-to-toes axis of the goalkeeper skate 110 is such that the heel part of skate 110 is arranged to be on a lower level compared to the toe part of the skate 110 with respect to the height from the horizontal surface, when the goalkeeper skate 110 is placed on a horizontal surface such that the medial M side of the goalkeeper skate 110 faces the horizontal surface.

FIG. 1B demonstrates the alignment of the foot in respect to the horizontal surface using a goalkeeper skate 110 with the support disclosed herein. As illustrated by FIG. 1B, the protrusion 101 of the support enables the heel-to-toes axis of the goalkeeper skate 110 to be such that the heel part of skate 110 is arranged to be on a higher level compared to the toe part of the skate 110 with respect to the height from the horizontal surface, when the goalkeeper skate 110 is placed on a horizontal surface such that the medial M side of the goalkeeper skate 110 faces the horizontal surface. When in use, the protrusion 101 of the support thus may reduce stress in lower extremities including hip, knee, and ankle joints with attached tendons and muscles of the goalkeeper.

The protrusion 101 of the support may be arrangeable on the goalkeeper skate 110 on the posterior side, i.e., heel side on the heel-to-toe axis, of the centre point of the foot. The protrusion 101 of the support may be arrangeable on the goalkeeper skate 110 such that when in place it is located below the tibia bone of the human foot inside the goalkeeper skate. The protrusion 101 of the support may be arrangeable on the talus and/or calcaneus of the human foot inside the goalkeeper skate 110. Anterior-posteriorly the location of the protrusion 101 may be between the dorsal or toe-side of the ankle and the heel. The location of the protrusion 101 may depend on the location and size of the leg pads of the goalkeeper.

From the point of the heel, a horizontal line parallel to the surface may be drawn. The angle of this line is 0 degrees. The angle of the heel-to-toe axis may be 0 degrees when the heel-to-toe axis is parallel to the horizontal surface. If the heel is closer to the horizontal surface than the toes, an additional angle α may be added to 0 degrees such that the heel-to-toe axis is 0 degrees+α>0 degrees. If the heel is further from the horizontal surface than the toes, an additional angle α may be subtracted from 0 degrees such that the heel-to-toe axis is 0 degrees—α<0 degrees. The protrusion may be arranged to align a heel-to-toes axis of the goalkeeper skate to be at an angle α, wherein the α is between 0 and −30 degrees, preferentially between 0 and −20 degrees, more preferentially between 0 and −10 degrees, most preferentially between 0 and −5 degrees with respect to horizontal plane when placing the goalkeeper skate onto a horizontal surface such that the medial M side of the goalkeeper skate faces the horizontal surface. The protrusion may be arranged to touch the horizontal surface only after the angle of the skate in respect to the horizontal surface is such that the blade of the skate does not touch the surface. This limitation prevents the protrusion from interfering with the blade during normal skating.

The protrusion 101 of the support may be of, but is not limited to, square, spherical, elliptical, or hemispherical shape. According to a preferential embodiment the protrusion may have an essentially hemispherical shape. The hemispherical shape facilitates smooth rotation and transition of the angle of the ankle. Furthermore, the hemispherical shape of the protrusion provides a minimal contact area with the horizontal surface regardless of the angle. Because the contact area of the protrusion is constant in relation to the surface regardless of the angle, the behaviour of the protrusion is smooth and predictable.

The material of the protrusion 101 of the support may comprise rigid material. The material of the protrusion 101 of the support may comprise elastic material. The material of the protrusion 101 of the support may be selected from a group of one or more of the following: plastics, rubber, silicone, elastomers, wood, leather, fiberglass, or carbon fibre. According to a preferential embodiment the outer surface of the protrusion may be hard. The hard outer surface may facilitate the gliding of the skate when the protrusion is touching the horizontal surface. According to a preferential embodiment the protrusion may be elastic with a hard surface. The elasticity absorbs hits and concussions thereby preventing or at least alleviating the damage to skeletal, connective, muscular and nervous tissue.

The diameter of the protrusion 101 of the support may be adapted to the size of the skate. The adaptation of the diameter of the protrusion 101 may depend on the location and size of the leg pads of the goalkeeper. The diameter of the base of the protrusion 101 that is arrangeable to the face of the medial M side of the skate may be, for example, 5 cm.

The support may be an external, removably attachable support. Alternatively, the support may be arranged as an integral part of the goalkeeper skate 110. When arranged as an integral, i.e., built-in part of the goalkeeper skate 110, the support may be arranged as an integral part of the boot of the goalkeeper skate 110 or as an integral part of the blade holder of the goalkeeper skate 110.

The height of the protrusion refers to a distance of a surface of the protrusion arranged to face the horizontal surface from the item from which the protrusion extends, when placing the support on the horizontal surface. In other words, the protrusion is arranged to extend from an item, for example a goalkeeper skate or boot. The distance that the protrusion extends may be called height of the protrusion. The height of the protrusion 101 of the support may be adjustable according to the individual differences in the goalkeeper's foot size and/or individual angular differences in the proportions of the lower extremities. For example, the height of the protrusion 101 may be 0.5-5 cm, preferentially 2.5 cm.

The protrusion 101 may comprise two or more parts. The first part of the protrusion 101 may be the base part that is arrangeable to the skate. In other words, the first part of the protrusion may be arrangeable to face the medial M side of the skate. The first part of the protrusion may have an elongated stud with threads. The second part of the protrusion 101 may be arranged to have a threaded structure corresponding to the threads of the first part of the protrusion 101. The second part of the protrusion 101 may be attachable to the first part of the protrusion 101. The attachment may be a threaded joint. The threads may be arranged to change the height of the protrusion 101. The threads may be arranged to retract the protrusion 101. The threaded joint facilitates the on-site change of the height of the protrusion 101 thereby enabling a more versatile use of the support.

The support may be arranged such that it compensates a width difference between a heel part of the foot and a broader toe part of the foot. The compensation in the width may be such that the distance of the heel from the essentially horizontal surface, for example ice, is increased. The increase of the distance may be such that the angle of the ankle of the goalkeeper is unstressed or normal. The unstressed or normal angle of the ankle may be an unbent angle. The change in the angle of the ankle may correct or alleviate the stress to knee and hip angles. The alleviation of the stress to bone joint angles may alleviate stress in muscles and/or tendons. The alleviation of the overall stress to the musculoskeletal system of the goalkeeper may reduce injuries and prevent or reduce the amount of long-term health effects of continuous stress to the musculoskeletal system of the lower extremities.

The support may have a height that is relative to the goalkeeper's and/or the goalkeeper skate's geometry in such a way that the height of the support enables the ankle and heel to retain natural position while the goalkeeper drops down to the butterfly position. The natural ankle and heel position may be an unbent angular position. The natural ankle position may reduce stress in the ankle. Reduced stress in the ankle may reduce stress in the knee. The reduced stress in the knee may reduce stress in the hip. Reduced skeletal stress may reduce stress on the tendons, muscles, and muscle membranes. The height of the support may be adjustable. The height of the support may refer to the height of the protrusion of the support.

Figure 2:
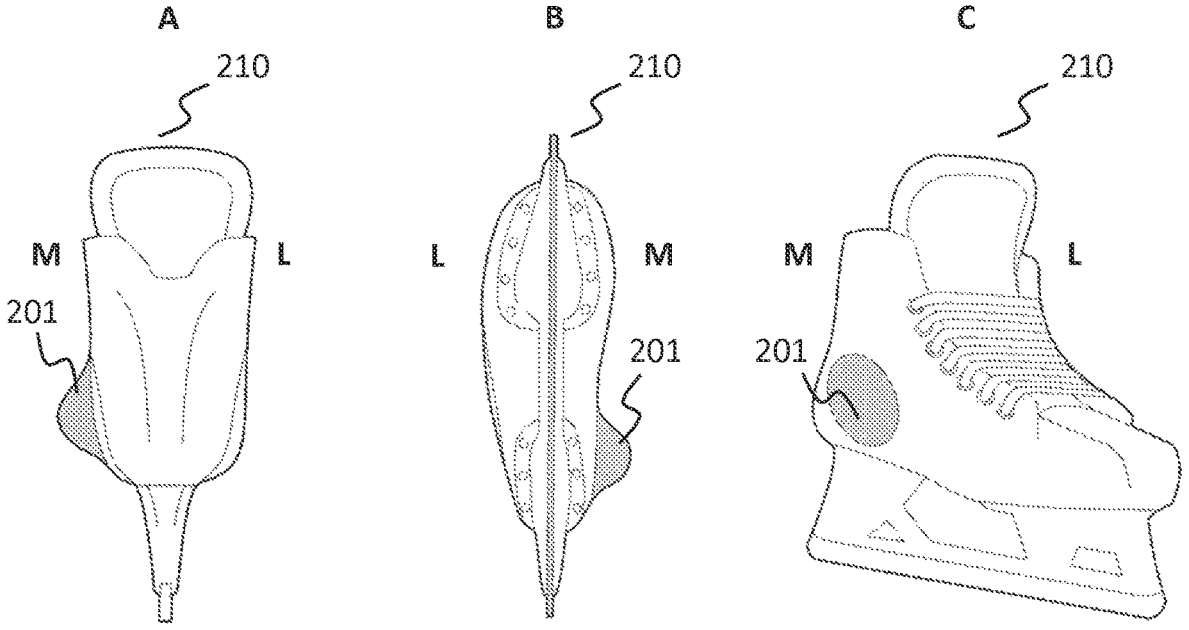
FIG. 2A, B, C demonstrates, by way of an example, an embodiment of the support viewed from behind (2A), from below (2B) and from the angled medial side projection (2C).

FIG. 2A demonstrates an embodiment of a goalkeeper skate provided with the support 201 viewed from behind, i.e., from behind the heel. FIG. 2B demonstrates an embodiment of a goalkeeper skate provided with a support 201 viewed from below, i.e., from the surface side or from the ice-side. FIG. 2C demonstrates an embodiment of a goalkeeper skate provided with the support 201 as an angled medial side projection.

Figure 3:
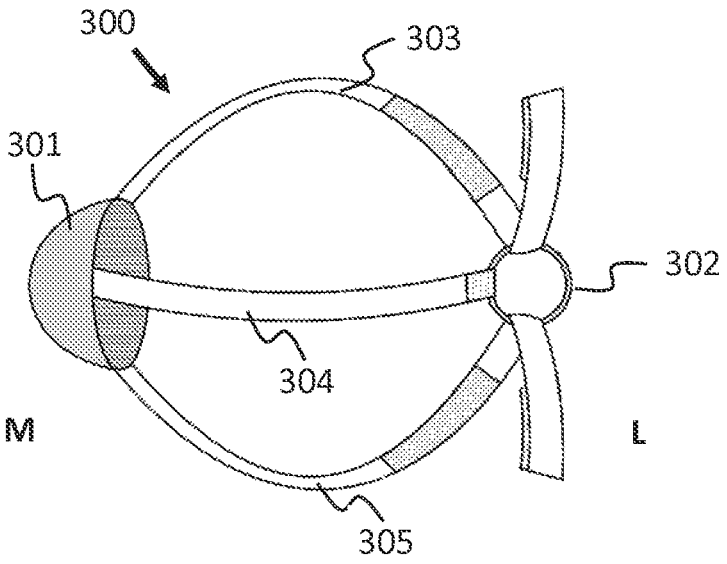
FIG. 3 demonstrates, by way of an example, an embodiment of removably attachable support.

FIG. 3 demonstrates an exemplary embodiment of a removably attachable support 300. The support 300 has a protrusion 301 for elevating the heel of the foot of the goalkeeper from the horizontal surface when placing the goalkeeper skate onto the surface such that the protrusion 301 faces the surface.

The removably attachable support may comprise one or more straps for attaching the support onto the skate. According to an embodiment illustrated in FIG. 3 the support is removably attachable to the medial M side of the goalkeeper skate using three straps 303, 304, 305. First strap 303 may be arranged to the front side or anterior side of the ankle. The first strap 303 may be arranged between the anterior side of the ankle and the metatarsus. Second strap 304 may be arranged to the heel side or posterior side of the ankle. Third strap 305 may be arranged to the footplate or ventral to the foot. The straps 303, 304, 305 may be connected on the lateral L side of the goalkeeper skate. The lateral L side may have a connection arrangement 302 for fastening and/or tightening the straps. Any of the straps 303, 304, 305 may comprise a Velcro material, i.e., hook-and-loop fastener material, for fast attachment. Any of the straps 303, 304, 305 may be a lace or a string that can be tied to fasten. Any of the straps 303, 304, 305 may be a synthetic, textile, or leather strap 303, 304, 305 that is connected and tightened using a buckle. The connection arrangement 302 may be a metal or plastic ring to which the straps 303, 304, 305 are connected. For example, Velcro straps 303, 304, 305 may be fastened and tightened rapidly by wrapping the Velcro around the above-mentioned ring as the connection arrangement 302. The connection arrangement 302 may have a quick-release fastener system to rapidly tighten the laces or strings without knots or buckles.

Figure 4:
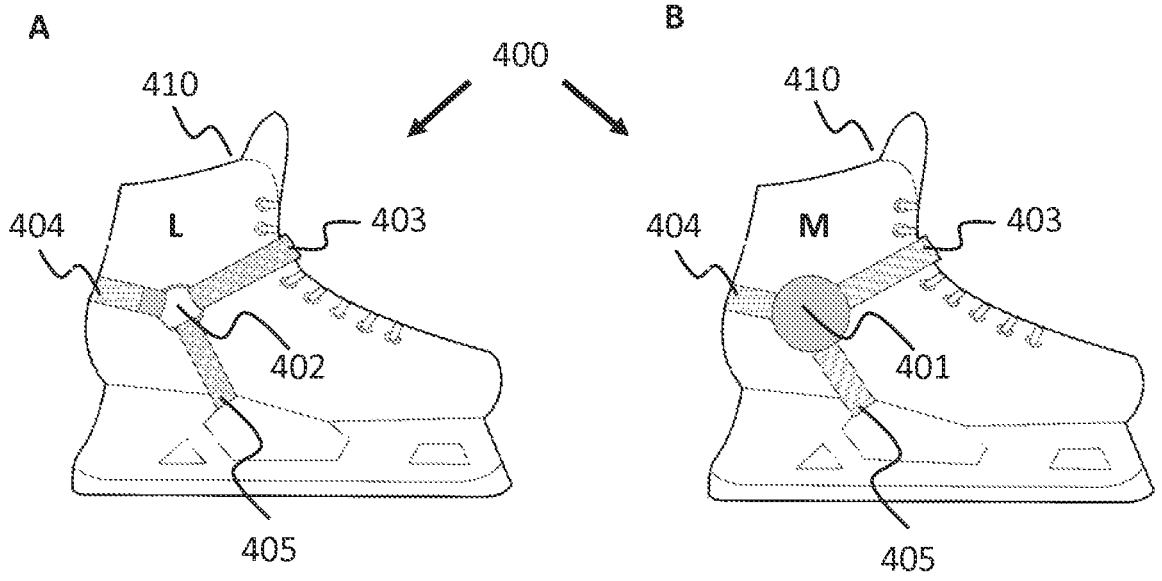
FIG. 4A, B demonstrates, by way of an example, a lateral view (A) and a medial view (B) of an embodiment of the support attached to a skate.

FIG. 4A demonstrates a lateral L view and FIG. 4B demonstrates a medial M view of an embodiment of a removably attachable support 400 attached to a goalkeeper skate 410. FIGS. 4A and 4B demonstrate an embodiment where the first strap 403 is arranged to the front side or anterior side of the skate 410, the second strap 404 is arranged to the heel side or posterior side of the skate 410, and the third strap 405 is arranged to the footplate or ventral to the footplate of the skate 410. The connection arrangement 402 on the lateral L (FIG. 4A) side may be used to fasten and tighten the protrusion 401 on the medial M (FIG. 4B) side using the connected straps 403, 404, 405.

Figure 5:
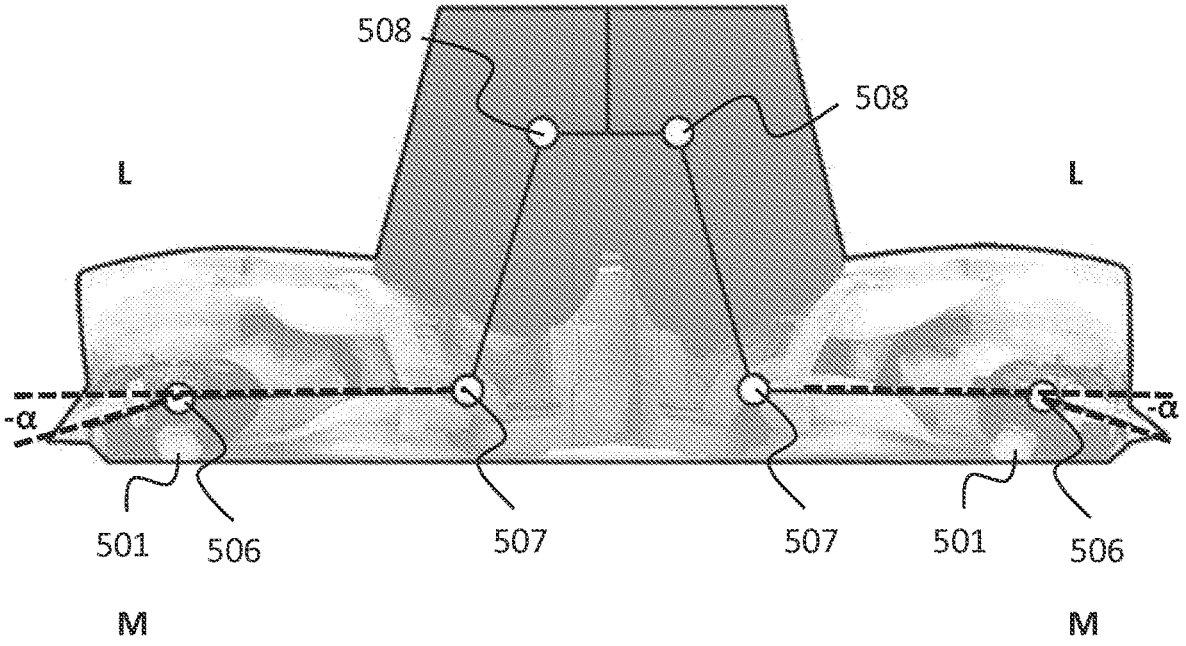
FIG. 5 demonstrates, by way of an example, a posterior view of a goalkeeper in a "butterfly position".

FIG. 5 demonstrates by way of an example, a posterior view of a goalkeeper in a "butterfly position". The protrusion 501 of the support prevents the heel from contacting the horizontal surface. The angle α between a line drawn parallel to the horizontal surface from the point of heel and a line along the heel-to-toe axis is negative. In this exemplary figure, the protrusion 501 of the support has a height of 2.5 cm. The angles of the ankles 506 of the goalkeeper affect the knee 507 angles and the hip 508 angles. Pronation of the ankles 506 provided by the support alleviates the torsion exhibited to skeletal, connective, muscular and nervous tissue.

According to an embodiment a support may be attached to a skate straplessly. An area from the ankle to the heel in the medial side of the skate may be covered, for example, with Velcro and the bottom side of a protrusion may have a corresponding Velcro. Because the Velcro on the skate has a large area, the protrusion may be straplessly and removably attached to a variable location on the medial side of the skate based on individual joint geometry and preference.

According to an embodiment a goalkeeper skate comprising the support as disclosed above is provided. The goalkeeper skate is for enclosing a human foot. As discussed above, the goalkeeper skate may comprise a built-in support or a removably attachable support. The support prevents or hinders the ankle and heel to drop down to a surface, such as ice, thereby allowing the lower extremities to maintain more physiological angles and providing less angular stress for example to the ankle, knee, and hip joints. This may also reduce the stress to supporting musculature and tendons.

The support comprises a protrusion located on the medial side of the goalkeeper skate. The support may be located between the anterior part of the ankle and the heel, preferentially below the tibia bone of the human foot inside the goalkeeper skate. The support may be located on the position of talus and/or calcaneus of the human foot inside the goalkeeper skate. The support may have a height that is relative to the goalkeeper's geometry in such a way that the height of the support enables the ankle and heel to retain natural position while the goalkeeper drops down to butterfly position. The natural ankle and heel position may be an unbent angular position. The natural ankle position may reduce stress in the ankle. Reduced stress in the ankle may reduce stress in the knee. The reduced stress in the knee may reduce stress in the hip. Reduced skeletal stress may reduce stress on the tendons, muscles, and muscle membranes. The height of the protrusion of the support may be adjustable.

The invention claimed is:

1. A support for a goalkeeper skate, comprising a protrusion arrangeable on a medial side of the goalkeeper skate wherein the protrusion is arranged to align a heel-to-toes axis of the goalkeeper skate to be at an angle (α) of from 0 to −30 degrees with respect to a horizontal plane when placing the goalkeeper skate onto a horizontal surface such that the medial side of the goalkeeper skate faces the horizontal surface, the protrusion of the support is arrangeable on the goalkeeper skate on a heel side on the heel-to-toes axis, and an outer surface of the protrusion is arranged to facilitate gliding of the skate when the protrusion is touching the horizontal surface.

2. The support according to claim 1, wherein the protrusion is arrangeable on the goalkeeper skate such that when in place it is located below the tibia bone of the human foot inside the goalkeeper skate.

3. The support according to claim 1, wherein the protrusion is of hemispherical shape.

4. The support according to claim 1, wherein the support is removably attachable onto a goalkeeper skate.

5. The support according to claim 4, wherein the removably attachable support comprises one or more straps for attaching the support onto the skate.

6. The support according to claim 5, wherein the one or more straps is/are arranged to be fastened and/or tightened using a connection arrangement.

7. The support according to claim 4, wherein the removably attachable support is arranged to be attached straplessly.

8. The support according to claim 1, wherein a height of the protrusion is at most 5 cm.

9. The support according to claim 1, wherein the height of the protrusion is adjustable.

10. A goalkeeper skate comprising the support according to claim 1.

11. The goalkeeper skate according to claim 10, wherein the support is arranged as an integral part of the goalkeeper skate.

12. A method for aligning joints in lower extremities including hip, knee, and ankle joints of a goalkeeper, comprising providing the support of claim 1 or a goalkeeper skate comprising the support.

* * * * *